US011168524B2

(12) United States Patent
Sehsah et al.

(10) Patent No.: US 11,168,524 B2
(45) Date of Patent: Nov. 9, 2021

(54) DRILLING SYSTEM WITH CIRCULATION SUB

(71) Applicant: Saudi Arabian Oil Company, Dhahran (SA)

(72) Inventors: Ossama Sehsah, Dhahran (SA); Ahmad Amoudi, Dhahran (SA); Abdulrahman Khalid Aleid, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/560,827

(22) Filed: Sep. 4, 2019

(65) Prior Publication Data

US 2021/0062590 A1 Mar. 4, 2021

(51) Int. Cl.
*E21B 17/18* (2006.01)
*E21B 21/12* (2006.01)

(52) U.S. Cl.
CPC ..... *E21B 17/18* (2013.01); *E21B 21/12* (2013.01)

(58) Field of Classification Search
CPC ..... E21B 17/18; E21B 17/203; E21B 21/12
See application file for complete search history.

(56) References Cited

U.S. PATENT DOCUMENTS 4,298,077 A 11/1981 Emery
4,361,193 A * 11/1982 Gravley ..... E21B 41/0078 175/61
4,632,193 A * 12/1986 Geczy ..... E21B 4/00 166/237
5,890,540 A 4/1999 Pia et al.
5,979,572 A 11/1999 Boyd et al.
6,173,795 B1 * 1/2001 McGarian ..... E21B 23/006 175/231
6,374,925 B1 4/2002 Elkins et al.
(Continued)

FOREIGN PATENT DOCUMENTS

WO 2009067485 A2 5/2009
WO 2019005029 A1 1/2019
WO 20190135775 A1 7/2019

OTHER PUBLICATIONS

PCT International Search Report issued in the prosecution of International Patent Application PCT/US2020049314 and dated Dec. 14, 2020, 13 pages.

*Primary Examiner* — Cathleen R Hutchins
*Assistant Examiner* — Ronald R Runyan
(74) *Attorney, Agent, or Firm* — Bracewell LLP; Constance Gall Rhebergen

(57) ABSTRACT

A drilling system for forming a wellbore includes a drill string, a drill bit, and a circulation sub in the drill string. Manipulating the circulation sub forms a passage through a sidewall of the drill string; which diverts some of the drilling fluid flowing inside the drill string into the wellbore. Diverting some of the drilling fluid through the passage reduces the amount of drilling fluid flowing in the wellbore between the drill bit and circulation sub, and which optimizes equivalent circulating density of the drilling fluid. Included in an embodiment of the circulation sub is a cylinder that is indexed into set positions by engagement with a J-slot profile in a housing of the circulation sub. A sleeve in the sub is responsive to cylinder positions, and has a port that registers with a slot in the sub walls to form the passage.

20 Claims, 7 Drawing Sheets

(56) References Cited

U.S. PATENT DOCUMENTS

| | | | |
|---|---|---|---|
| 6,415,877 | B1 | 7/2002 | Fincher et al. |
| 6,820,697 | B1 | 11/2004 | Churchill |
| 7,044,239 | B2 | 5/2006 | Pinckard et al. |
| 7,096,975 | B2 | 8/2006 | Aronstametal |
| 7,108,080 | B2 | 9/2006 | Tessari et al. |
| 7,174,975 | B2 | 2/2007 | Krueger et al. |
| 7,270,185 | B2 | 9/2007 | Fontana et al. |
| 8,567,525 | B2 | 10/2013 | Reitsma |
| 8,636,060 | B2 | 1/2014 | Hernandez |
| 8,863,852 | B2 | 10/2014 | Clausen |
| 9,279,301 | B2 | 3/2016 | Lovorn et al. |
| 9,605,507 | B2 | 3/2017 | Lovorn et al. |
| 2015/0184504 | A1 | 7/2015 | Ringer et al. |
| 2015/0240593 | A1 | 8/2015 | Stolboushkin |
| 2017/0247959 | A1 | 8/2017 | Dirksen et al. |
| 2018/0179855 | A1 | 6/2018 | Messa et al. |

* cited by examiner

DRILLING SYSTEM WITH CIRCULATION SUB

BACKGROUND OF THE INVENTION

1. Field of Invention

The present disclosure relates to a system and method for drilling a wellbore. More particularly, the present disclosure relates to a system a method for drilling a wellbore that optimizes wellbore cleaning and equivalent circulating density in the wellbore with a fluid bypass.

2. Description of Prior Art

Hydrocarbon producing wellbores extend subsurface and intersect subterranean formations where hydrocarbons are trapped. The wellbores are usually formed by drilling systems that include a drill string made up of a drill bit mounted to a length of interconnected pipe. Typically a top drive or rotary table above the opening to the wellbore rotates the drill string. Cutting elements on the drill bit scrape the bottom of the wellbore as the bit is rotated and excavate material thereby deepening the wellbore. Drilling fluid is typically pumped down the drill string and directed from the drill bit into the wellbore; the drilling fluid then flows back up the wellbore in an annulus between the drill string and walls of the wellbore. Cuttings are produced while excavating and are carried up the wellbore with the circulating drilling fluid.

Drilling fluid properties and parameters are usually monitored during drilling, and varied when necessary in response to changes in downhole conditions, formation characteristics, or both. Usually, the drilling fluid density is controlled so that pressures inside the wellbore are maintained at a level to prevent an influx of fluid flow from the surrounding formation; which is sometimes referred to as a kick. Conversely, too great of a drilling fluid density can overbalance the wellbore due to pressure in the drilling fluid column to a level that introduces a risk of drilling fluid loss; such as by exceeding a fracture gradient of the formation or by invading a lost circulation zone. Drilling fluid flowrate is also analyzed during drilling, as the pressure gradients caused by greater flowrates in turn produce larger pressures in the fluid column. One technique employed to account for interactions between the drilling fluid and formation during drilling operations estimates an equivalent circulating density ("ECD") of the flowing drilling fluid, and which adds drilling fluid density to the pressure drop from surface to wellbore bottom divided by the wellbore true vertical depth.

SUMMARY OF THE INVENTION

An example of a drilling system for use to excavate in a wellbore is described herein which includes a drill string, a drill bit on an end of the drill string, and a circulation sub coupled to the drill string. The circulation sub includes a selectively rotatable cam cylinder having a receiving end in fluid communication with the drill string, sidewalls projecting axially from the receiving end having a varying axial length around a circumference of the cam cylinder, and a sleeve end at a terminal end of the sidewalls opposite from the receiving end, a sleeve having a cylinder end in contact with the sleeve end, and that is axially moveable in response to rotation of the cam cylinder, and an opening formed radially through a sidewall of the circulation sub that selectively registers with a port in a sidewall of the sleeve when the cam cylinder is in a designated azimuthal orientation to define a passage through which an inside the circulation sub is in communication with the wellbore. The drilling system further optionally includes a groove pattern formed in a surface of the circulation sub and a following pin mounted to the cam cylinder inserted into the groove pattern, so the cam cylinder is rotated about an axis of the circulation sub in response to being axially urged. In one example, the designated azimuthal orientation includes a first designated azimuthal orientation, and wherein the groove pattern and following pin are strategically formed so that orienting the following pin into a second designated azimuthal orientation partially registers the opening and the port. Alternatively the designated azimuthal orientation includes a first designated azimuthal orientation, and wherein the groove pattern and following pin are strategically formed so that orienting the following pin into a third designated azimuthal orientation positions the port away from the opening. In an embodiment, varying an axial length of the sidewalls of the cam cylinder define a helically shaped profile along the sleeve end. In an alternative, the drilling system further includes an orifice formed axially in the cam cylinder. In this example, fluid flowing through the drill string is directed through the orifice, and which generates a force to urge the cam cylinder against the sleeve. The cylinder end is optionally profiled complementary to the sleeve end. In one embodiment, an urging means is on an end of the sleeve opposite the cylinder end for urging the sleeve against the cam cylinder so that the cylinder end and sleeve end are in engaging contact while the cam cylinder is rotated. In an alternative, a diameter of the drill string is reduced at a swage point between the circulation sub and the drill bit. In this example, the swage point is disposed proximate a diameter transition in the wellbore.

Another example of a drilling system for use to excavate in a wellbore is described herein and which includes a drill string having an inner bore with a selective flow of fluid, a drill bit on an end of the drill string, a change in diameter of the drill string that defines a transition, and a circulation sub in the drill string. The circulation sub of this example includes a housing with a bore that is in fluid communication with the inner bore of the drill string, a cam cylinder selectively rotatable in the bore of the housing and having sidewalls with an axial length that varies about a circumference of the cam cylinder, and a passage formed radially through the housing when the cam cylinder is in a designated azimuth. The drilling system optionally further includes a sleeve in biasing contact with the cam cylinder, and that is selectively moved axially within the bore of the housing in response to rotation of the cam cylinder. The passage is optionally formed by registering an opening in a side of the housing with a port in a side of the sleeve. Alternatives exist where the cam cylinder and sleeve are in contact with one another along respective ends that are helically shaped.

A method of using a drilling system to excavate in a wellbore is also disclosed herein and which includes contacting a drill bit with a subterranean formation, rotating a drill string that is attached to the drill bit, directing a flow of fluid through the drill string, selectively diverting a portion of the flow of fluid into the wellbore uphole of the drill bit by indexing a cam cylinder integral with the drill string into an orientation that creates fluid communication between the fluid flowing through the drill string and the wellbore. In an example, the cam cylinder is part of a circulation sub that further comprises a sleeve disposed coaxial with the cam cylinder and having a port formed radially through a sidewall that registers with an opening in a side of the circulation sub to form a passage, wherein fluid communication between the fluid flowing through the drill string and the wellbore bore is through the passage. In an alternative, selectively diverting a portion of the flow of fluid into the wellbore adjusts an equivalent circulating density of the fluid in the wellbore. The fluid is optionally diverted into the wellbore proximate where an inner diameter of the wellbore transitions to a different size and proximate where an outer diameter of the drill string transitions to a different size. In one example, the cam cylinder and sleeve are each generally annular members having sidewalls that each having an axial length that varies azimuthally so that ends of each of the sidewalls follow a helically shaped path, and wherein the ends following the helically shaped path are in contact with one another so that the sleeve moves axially with rotation of the cam cylinder, and wherein an orifice is disposed in the cam cylinder through which the flow of fluid in the drill string is directed and exerts a force onto the cam cylinder that varies with a flowrate of the flow of fluid.

BRIEF DESCRIPTION OF DRAWINGS

Some of the features and benefits of the present invention having been stated, others will become apparent as the description proceeds when taken in conjunction with the accompanying drawings, in which.

Figure 1:
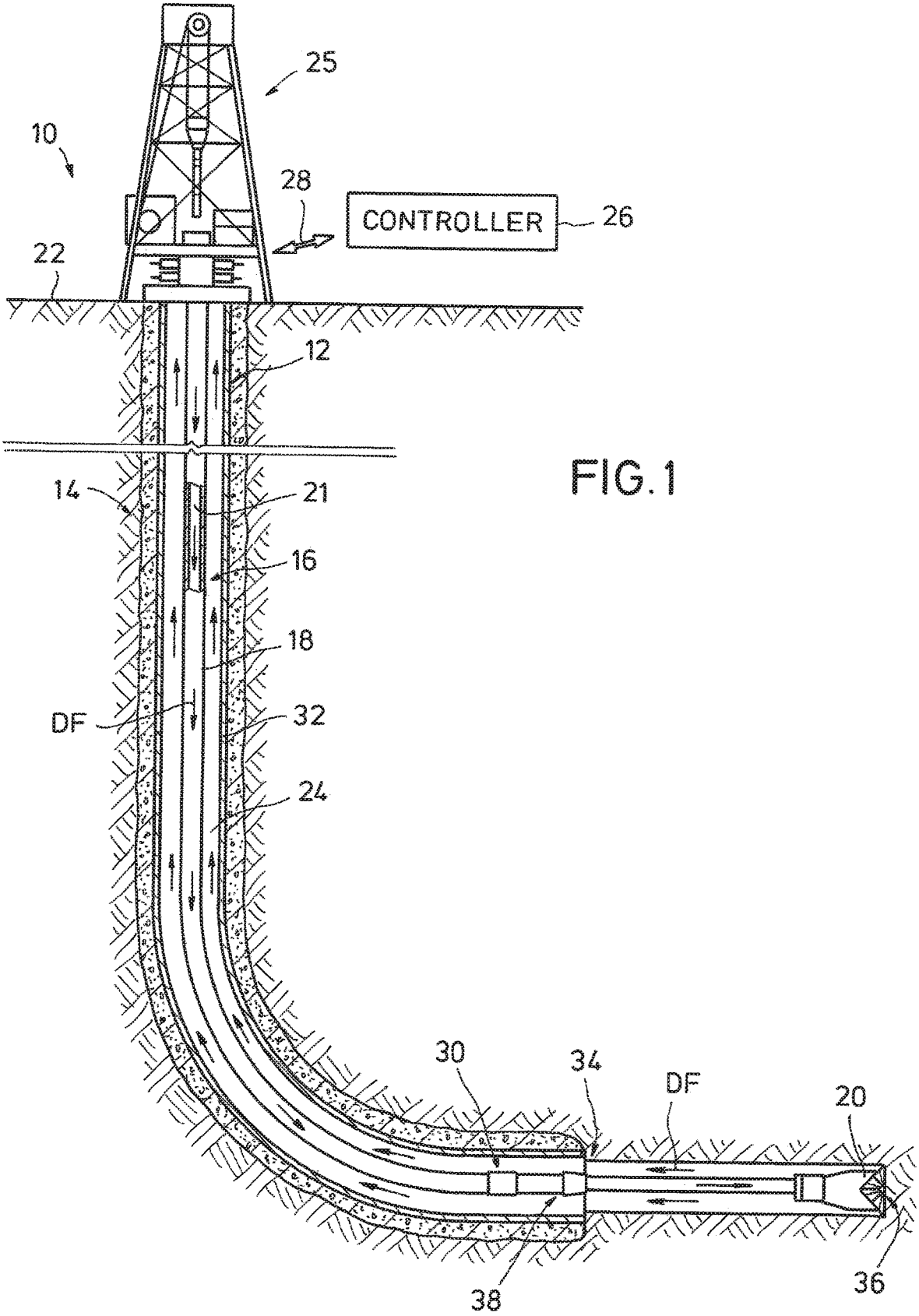
FIG. 1 is a side partial sectional view of an example of a drilling system forming a wellbore and having a circulation sub.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a partial side sectional view in FIG. 1, is an example of a drilling system 10 forming a wellbore 12 through a subterranean formation 14. The drilling system 10 includes a drill string 16 that is made up of an elongated pipe string 18, and a drill bit 20 on a lower end of the pipe string 18. Drilling fluid DF is shown being pumped down inside a bore 21 of the pipe string 18, which exits nozzles (not shown) on a lower end of a bit 20; the drilling fluid DF is recirculated back to surface 22 within an annulus 24 between the pipe string 18 and side walls of wellbore 12. Also on surface 22 is a drilling rig 25 for operating and controlling the drill string 16. In one example, the drill string 16 is rotated by a top drive included within the drilling rig 25; alternatively a rotary drive drives the drill string 16. Schematically illustrated is an optional controller 26 for use in managing operation of the drilling rig 25; that is an example initiates and provides command signals to the drilling rig 25, and receives and interprets data signals from the drilling rig 25 as well as the drilling string 16. An example of a communication means 28 is schematically shown, which in an embodiment provide communication from drilling rig 25 and/or wellbore 12 to controller 26.

Further in this example, a circulation sub 30 is integrally formed within the pipe string 18, and as described in more detail below provides a selective means for diverting a portion of drilling fluid DF from within bore 21 and into annulus 24 uphole of bit 20. In the example of FIG. 1 a portion of wellbore 12 is lined with casing 32 and which terminates at a depth so that a portion of the wellbore 12 is lined, leaving a portion of wellbore 12 unlined or open hole. Also in the illustrated example a transition 34 is identified, which represents a location where a diameter of wellbore 12 changes to a lower diameter. As shown, diameter of wellbore 12 is substantially the same between transition 34 and to a wellbore bottom 36. The pipe string 18 of FIG. 1 also experiences a change in diameter at a transition 38, which is shown in a portion of drill pipe 18 between circulation sub 30 and bit 20 and further represented by a pipe swage.

Figure 2:
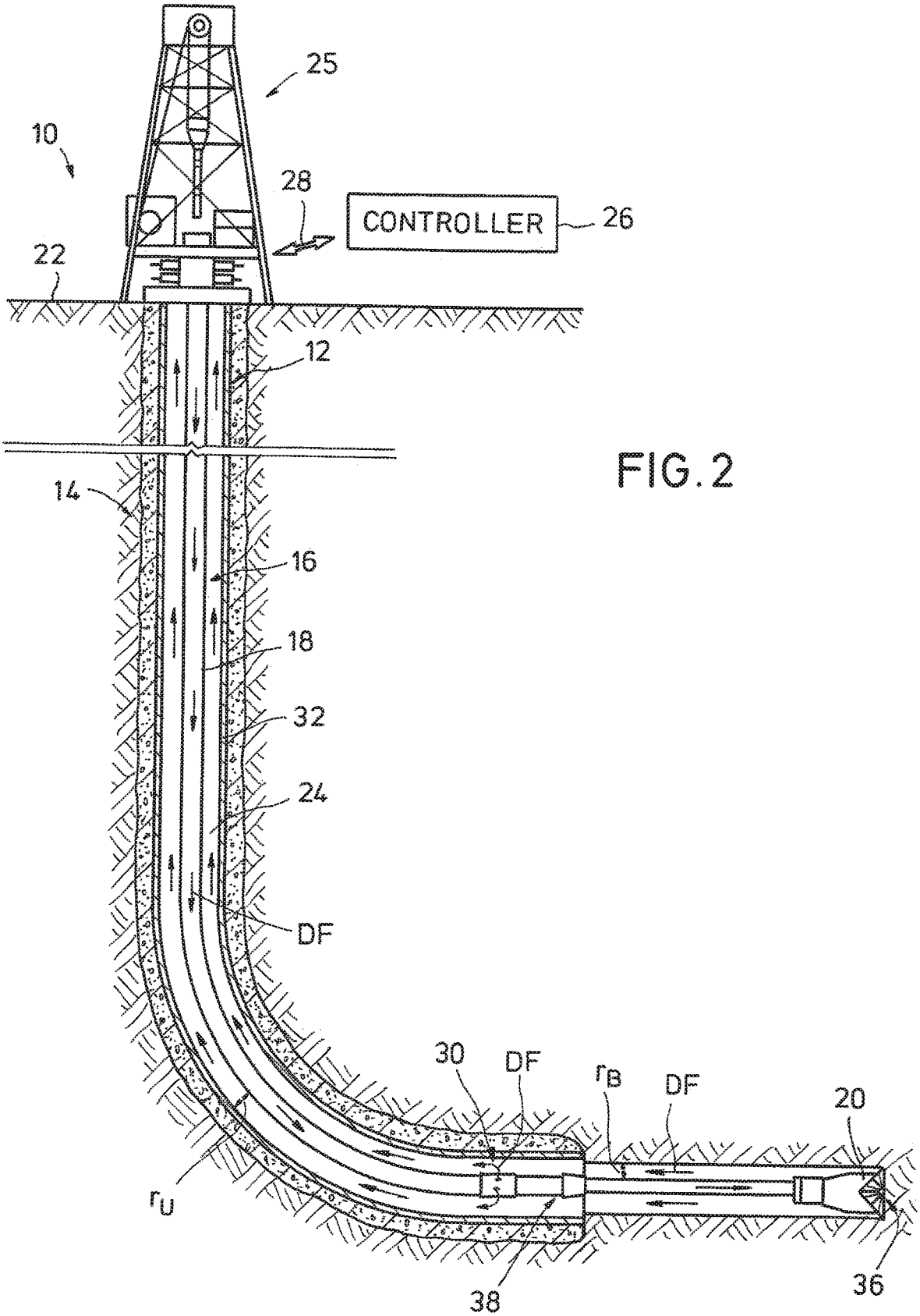
FIG. 2 is a side partial sectional view of the drilling system of FIG. 1 with drilling fluid bypassing a portion of a drill string of the drilling system.

Depicted in FIG. 2 is an example of the drilling system 10 with the circulation sub 30 selectively activated and diverting a portion of drilling fluid DF from within bore 21 of drill string 16 and into annulus 24. Bypassing a portion of the drilling fluid travel (i.e., the respective portions of drill string 16 and wellbore 12 between circulation sub and wellbore bottom 36) reduces dynamic pressure losses of the diverted drilling fluid DF. Because pressure losses experienced by drilling fluid affect its values of equivalent circulating density ("ECD"), diverting a portion of the drilling fluid DF uphole of the drill bit 20 lowers the overall ECD of the drilling fluid DF. In one example, ECD is optimized by strategic placement of the circulating sub 30, and/or regulating the amount of flow of the drilling fluid DF being diverted. Examples of optimizing the ECD are to take into account particular characteristics of the formation 14, such as its fracture strength, and potentially weaker zones that could introduce a lost circulation zone. Cleaning of debris from within wellbore 12 can also be optimized with the step of diverting. For example, cleaning debris from within wellbore with the step of diverting maintains a velocity of the drilling fluid DF sufficient to carry any cuttings uphole into surface 24.

Further in the example of FIG. 2, strategic placement of the circulation sub 30 addresses the changes in cross-sectional area introduced by the transitions 34, 38. For example, a radius $r_B$ shown between an outer surface of the drill pipe 18 and inner surface of wellbore 12 is less than a corresponding radius $r_U$ that is uphole of the circulation sub 30. Without the portion of the drilling fluid DF being diverted from circulation sub 30, a velocity of the drilling fluid DF in the section of wellbore 12 having an effective radius of $r_B$ would be greater than the portion of wellbore having effective radius $r_U$, which in some examples raises the ECD to above an acceptable level, and introduce erosion from the high velocity in this open hole section. Thus, the technique of optimizing ECD by diverting a portion of the drilling fluid DF described herein provides an advantageous approach to drilling a wellbore when different diameter wellbores and/or drill pipe are encountered.

Figure 3A:
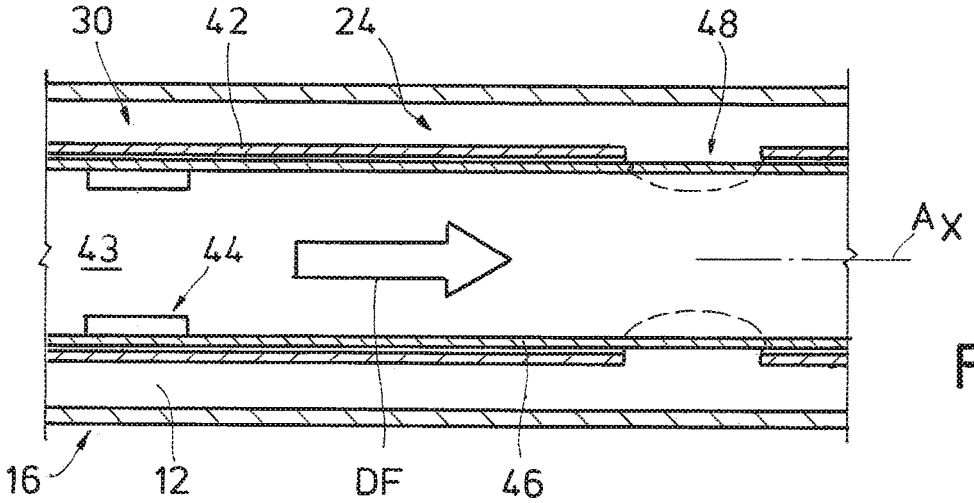
FIGS. 3A-3C are side partial sectional schematic views of examples of operation of an embodiment of the circulation sub of FIGS. 1 and 2.
Figure 3B:
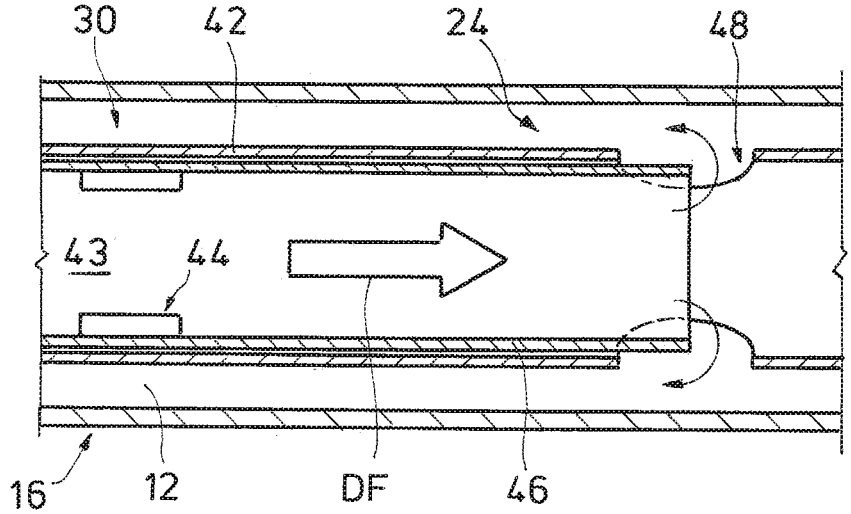
Figure 3C:
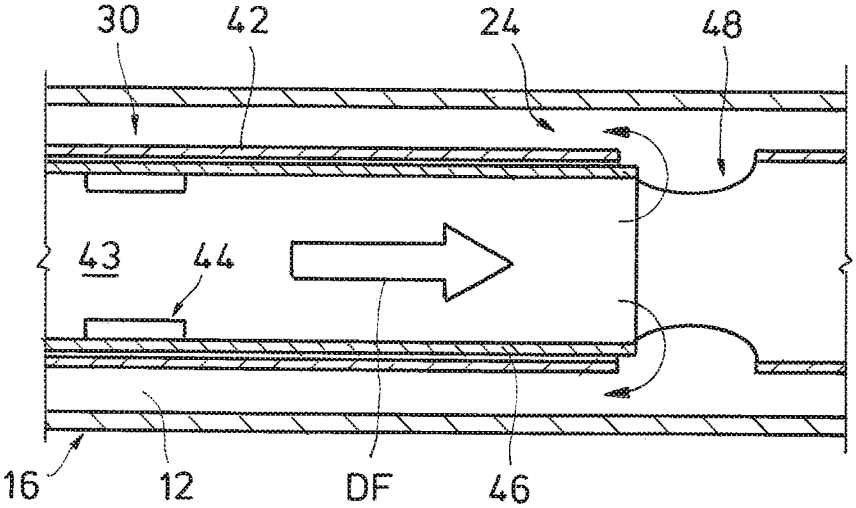

Schematically shown in a side partial sectional view in FIGS. 3A through 3C are example operational modes of the circulation sub 30 and disposed within drilling string 16. In the illustrated example, circulation sub 30 includes a housing 42 in which a bore 43 is shown extending along an axis $A_X$ of circulation sub 30. Further, bore 43 is in fluid communication with bore 21 (FIG. 1) of the drill string 16. Shown in FIG. 3A is an example of an unactivated or closed configuration of the circulation sub 30; in which drilling fluid DF remains within the drill string 16 and is flowing axially through and past the circulation sub 30. Schematically represented in FIG. 3B is an example of circulation sub 30 in a "selective release" configuration. In the illustrated embodiment a CAM system 44 provided with circulation sub 30 is selectively activated, which causes circulation sub sleeves 46 to move axially within and with respect to housing 42. The movement of sleeve 46 positions sleeve 46 away from an opening 48 formed radially through housing 42, and which provides fluid communication between bore 43 and annulus 24 of wellbore 12. In the example of operation illustrated in FIG. 3B, sleeve 46 is adjacent a portion of opening 48 so that less than all of opening 48 is exposed to bore 43. In FIG. 3C sleeve 46 is shown moved farther axially which fully exposes opening 48 to bore 43, and puts the circulation sub 30 into a bypass or diverting configuration so that a portion of drilling fluid DF flowing inside drill string 16 is bypassed or diverted into annulus 24. Examples exist where a flow rate of the portion of the drilling fluid DF being bypassed or diverted through the openings 48 is set by strategic sizing of the openings 48 in conjunction with the relative dimensions of the drill string 16 and respective pressures in bore 43 and annulus 24. Means for activating the CAM system 44 include telemetry from surface 22 (FIG. 1), hard-wired signals, and variations in flow or pressure of the drilling fluid DF.

Figure 4:
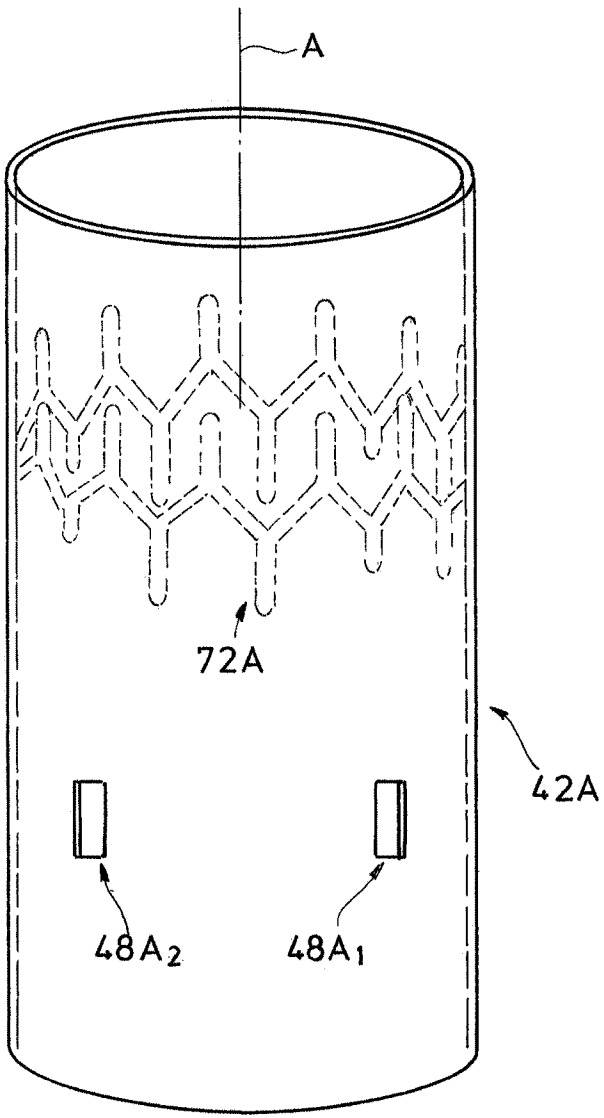
FIG. 4 is a perspective view of an example of a CAM cylinder and a sleeve for use with the circulation sub of FIGS. 1 and 2.

Referring now to FIG. 4, depicted in a perspective view is an example of a portion of a CAM system 44A which includes an annular CAM cylinder 50A. A skirt 52A of CAM cylinder 50A has an axial length $L_{44A(\Theta)}$ that varies with circumference of the CAM cylinder 50A. The varying length of the skirt 52A results in a sleeve end 54A which is on an end of skirt 52A, and that follows a generally helical path around the circumference of the CAM cylinder 50A. The helical shape of sleeve end 54A results in a radial edge 56A being formed on an outer circumference of the CAM cylinder 50A; as shown radial edge 56A axially extends between portions of skirt 52A having the shortest and longest axial lengths $L_{44A(\Theta)}$, and along a path generally parallel with axis $A_X$. Projecting radially outward from skirt 52A is a following pin 58A. Following pin 58A is shown mounted proximate the radial edge 56A distal from sleeve end 54A, and on a circumferential portion of skirt 52A where a value of axial length $L_{44A(\Theta)}$ is roughly close to a maximum value. Moreover in this example, following pin 58A is shown to have a generally cylindrical configuration, but is not limited to that shape and can take on any other similar like object that projects radially from an outer surface of skirt 52A. CAM cylinder 50A has a receiving end 59A that is axially opposite from the sleeve end 54A, and on which a planar end wall 60A is disposed. End wall 60A is shown oriented in a plane substantially perpendicular with axis $A_X$. An orifice 62A is shown formed through a middle portion of end wall 60A. Other embodiments are envisioned where orifice 62A is positioned at different locations of end wall 60A, as well as being made up of multiple openings intersecting end wall 60A.

Still referring to FIG. 4, an example of circulation sub sleeve 46A is shown in a perspective view and spaced axially from CAM cylinder 50A. In the example, sleeve 46A is a generally annular member with an axially extending skirt 63A on its outer circumference; like skirt 52A of CAM cylinder 50A, skirt 63A has an axial length $L_{63A(\Theta)}$ that varies along a circumference of sleeve 46A. A terminal end of skirt 63A facing CAM cylinder 50A defines a cylinder end 64A, and which follows a generally helical path about axis $A_X$. In an example, the helical shape of cylinder end 64A is substantially complementary to the sleeve end 54A. Also like the CAM cylinder 50A, a radial edge 66A is defined on skirt 63A where axial length $L_{63A(\Theta)}$ changes abruptly due to the helical shape of the cylinder end 64A. Also in the sidewalls are ports 68$A_{1,2}$ that project radially through skirt 63A. The axial ends of skirt 63A form a rearward end 69A and on side opposite the cylinder end 64A. In the example of FIG. 4, the rearward end 69A lies in a plane that is substantially parallel with axis $A_X$.

Figure 5A:
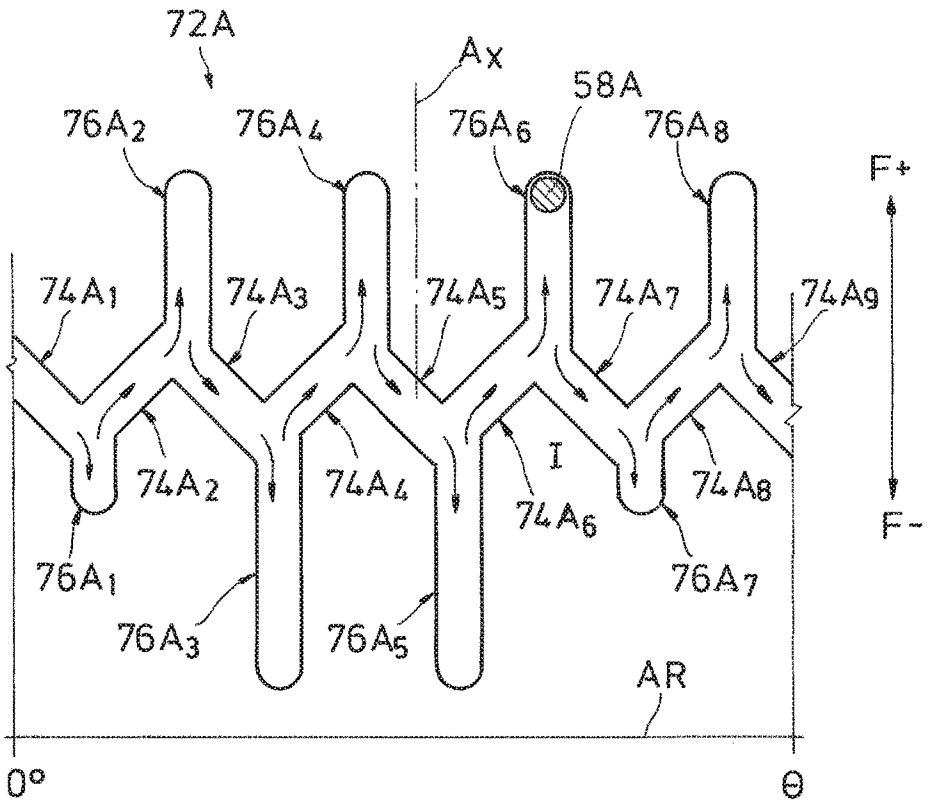
FIG. 5A is a schematic example of a groove pattern of the circulation sub of FIG. 5.
Figure 5:
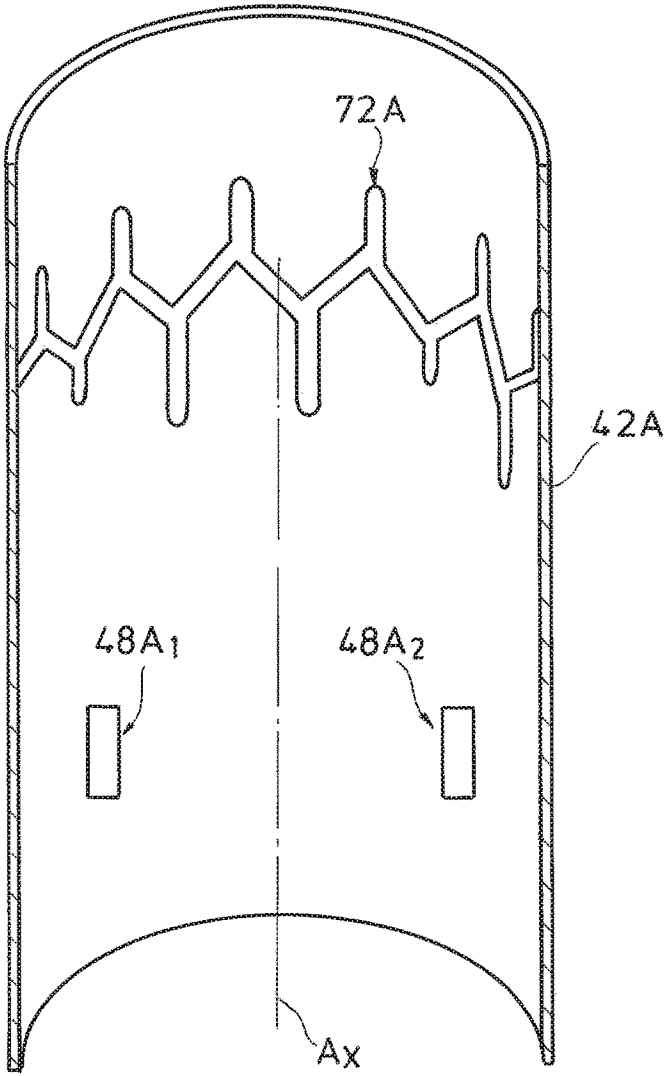
FIG. 5 is a sectional view of an example of a housing of a circulation sub of FIGS. 1 and 2.

Referring now to FIG. 5, shown is a section of an example of housing 42A. Openings 48$A_{1,2}$ are formed radially through its sidewall, and a groove pattern 72A is illustrated circumscribing an inner surface of housing 42A at an axial location. An example of groove pattern 72A is schematically represented in FIG. 5A in a two-dimensional depiction. An axis $A_R$ is included in FIG. 5A with angular values corresponding to an example span of groove pattern 72A as disposed along the inner circumference of housing 42A. Represented on axis $A_R$ are angles ranging from 0° to Θ, where in one example 0 is equal to 360°. In the embodiment depicted, groove pattern 72A is made up of a number of oblique legs 74$A_{1\text{-}9}$ that interconnect between a number of angularly spaced apart vertical legs 76$A_{1\text{-}8}$. The legs 74$A_{1\text{-}9}$, 76$A_{1\text{-}8}$ are formed by grooves or channels cut into the inner surface of housing 42A, and which selectively receive following pin 58A. As reflected in FIG. 5A, vertical legs 76$A_{1\text{-}8}$ are elongate portions of groove pattern 72A that are oriented substantially parallel with axis $A_X$; and oblique legs 74$A_{6,19}$ are also elongate and oriented oblique with axis $A_X$. In the illustrated embodiment, vertical legs 76$A_{1,\ 3,\ 5,\ 7}$ project towards openings 48$A_{1,2}$, and vertical legs 76$A2_{2,\ 4,\ 6,\ 8}$ project away from openings 48$A_{1,\ 2}$. Optionally depicted is that axial lengths of vertical legs 76$A_{3,\ 5}$ are greater than that of vertical legs 76$A_{1,\ 2,\ 4,\ 6,\ 7,\ 8}$. Legs 74$A_{1\text{-}9}$, 76$A_{1\text{-}8}$ and following pin 58A are respectively dimensioned so that when following pin 58A is inserted into one of the legs 74$A_{1-9}$, 76$A_{1-8}$ and an axial force is applied to the following pin 58A, interference between sidewalls of the legs 74$A_{1-9}$, 76$A_{1-8}$ and following pin 58A guide the following pin 58A within groove pattern 72A along a designated path.

In a non-limiting example of operation, following pin 58A is shown disposed within a terminal end of vertical leg 76$A_6$ and represents one position of travel of the following pin 58A within the groove pattern 72A. Further in this example of operation, a vertical force F− in the direction shown is applied onto CAM cylinder 50A (FIG. 4), following pin 58A through its attachment to CAM cylinder 50A is urged towards respective entrances to oblique legs 76$A_{6,7}$; sidewalls of vertical leg 76$A_6$ maintains following pin 58A within vertical leg until following pin 58A reaches oblique legs 74$A_{6,7}$. Strategic formation of oblique legs 74$A_{6,7}$ and interface I between them directs following pin 58A into oblique leg 74$A_7$ rather than oblique leg 74$A_6$. Continued application of force F− results in following pin 58A being urged into vertical leg 76$A_7$. Similar to the way described above, applying a force F+ in the direction shown urges following pin 58A from vertical leg 76$A_7$ and into vertical leg 76$A_8$. Successive applications of force F− and F+ in the respective directions as shown, guides following pin 58A throughout groove pattern 72A and within each of the legs 74$A_{1-9}$, 76$A_{1-8}$. As the guide pattern 72A extends along an angular curved path as represented by angular axis $A_R$, application of the forces F− and F+ in alternating directions as described above rotates the CAM cylinder 50 with respect to the housing 42A.

Figure 6:
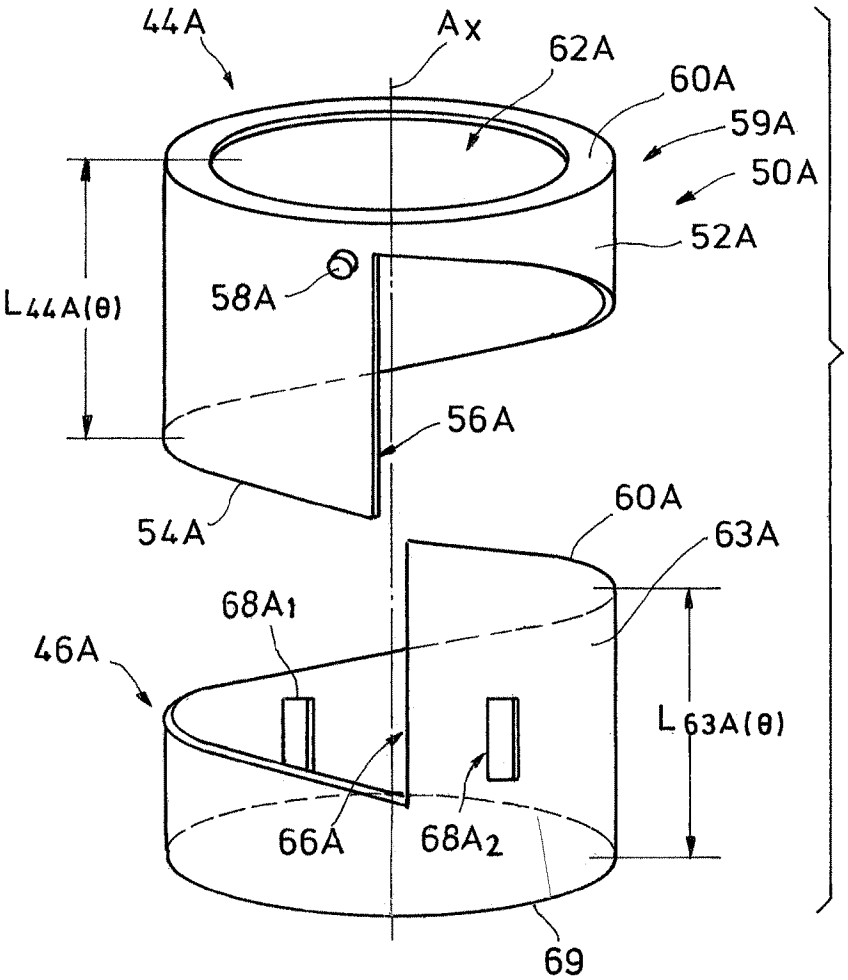
FIG. 6 is a perspective view of a housing of the circulation sub of FIGS. 1 and 2.

Shown in FIG. 6 is a perspective view of the housing 42A; groove pattern 72A is shown along an inner surface of the housing 42A in phantom dash outline. Examples exist where a single and unique groove pattern 72A extends the full 360° inside the housing 42A; in other examples groove pattern 72A repeats two or more times along the 360° travel inside the housing 42A. As reflected in FIGS. 5 and 6, groove pattern 72A and openings 48$A_{1,2}$ are spaced apart from one another along axis $A_X$. Openings 48$A_{1,2}$ are shown as generally rectangular and at substantially the same axial location on housing 42A, alternatively openings 48$A_{1,2}$ are circular or oval and are positioned axially apart from one another.

Figure 7B:
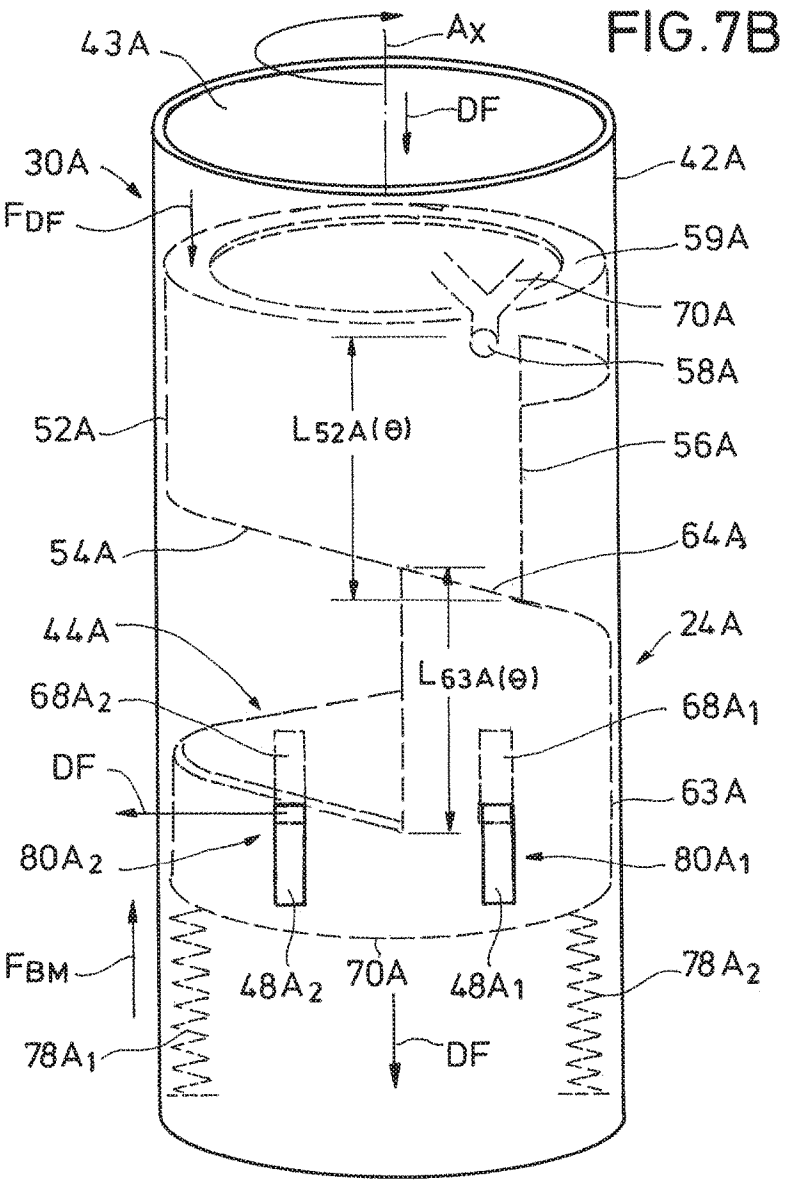
FIGS. 7A-7C are perspective views of examples of operation of the circulation sub of FIGS. 1 and 2.
Figure 7A:
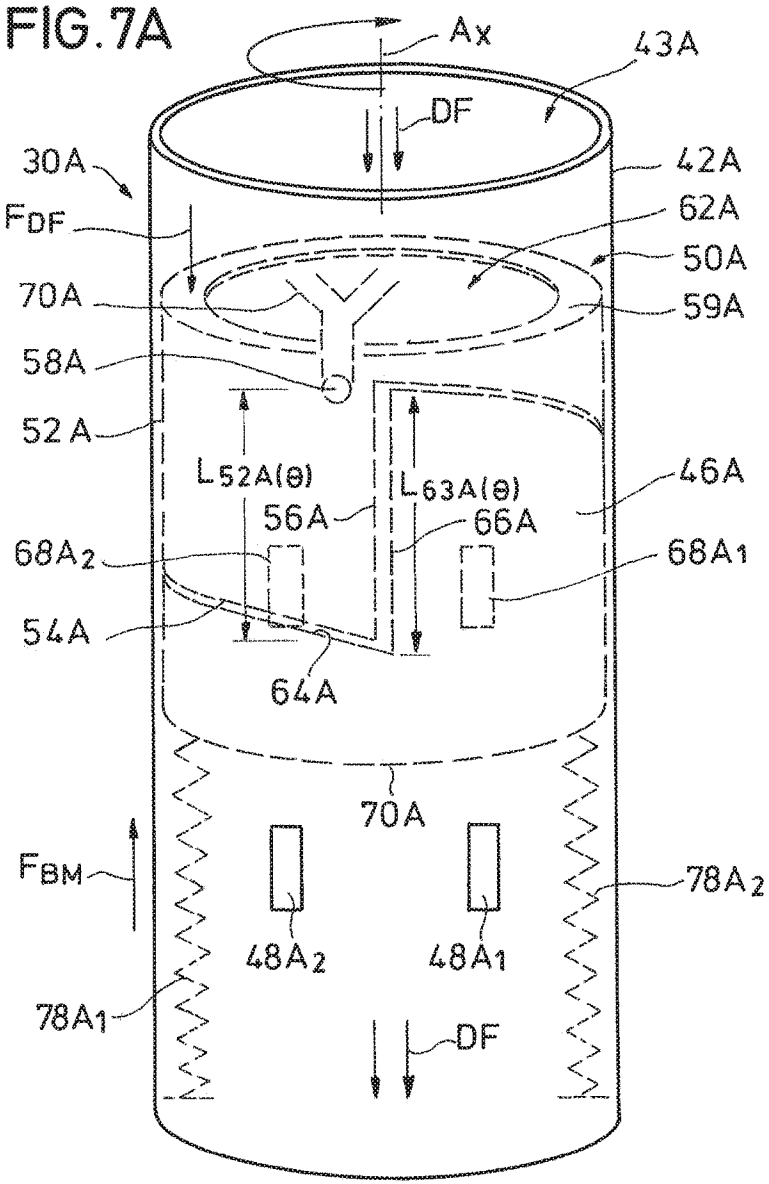
Figure 7C:
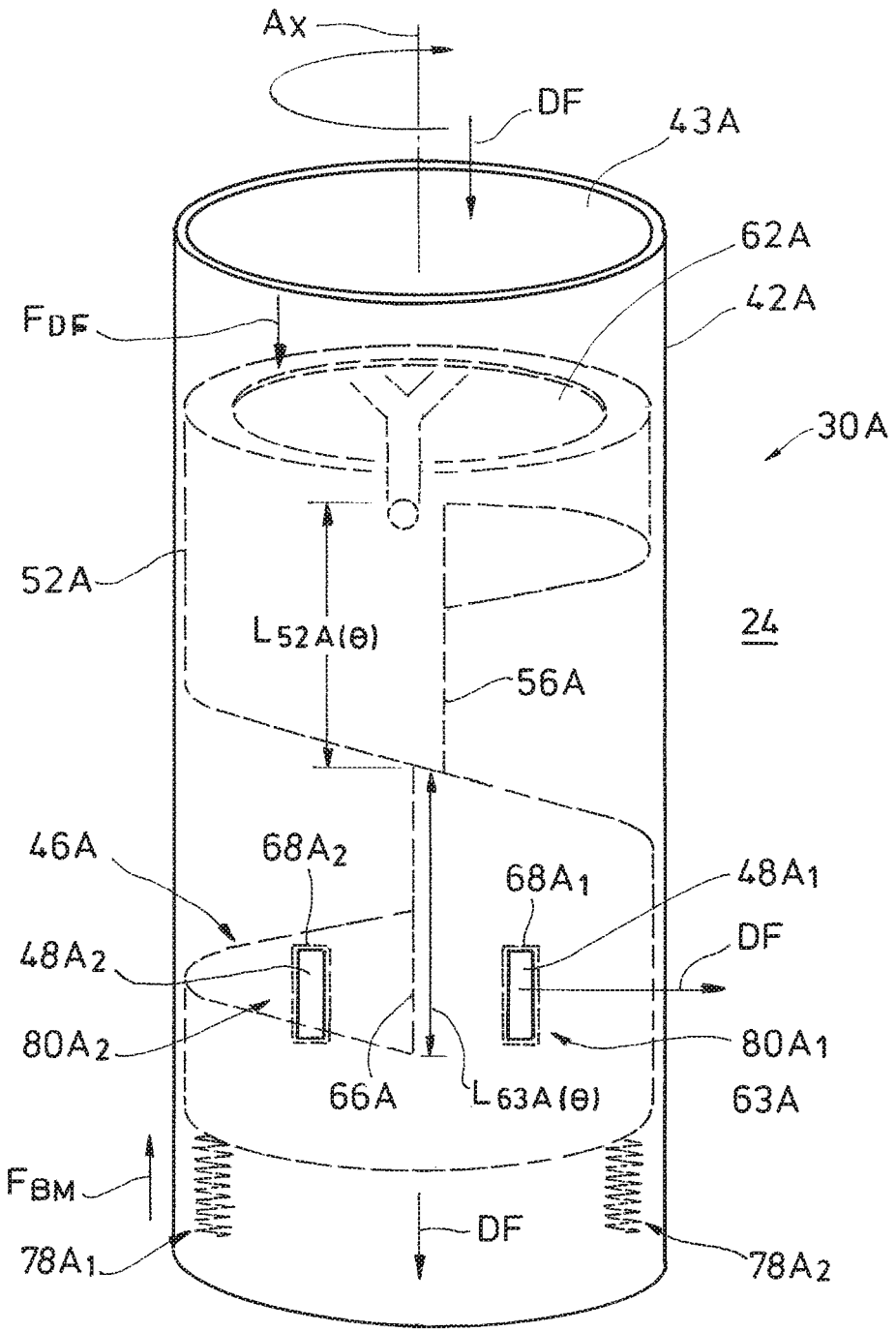

Referring now to FIGS. 7A, 7B, and 7C, shown in a perspective view is a non-limiting example of operation of the circulation sub 30A. As noted above, bore 43A of circulation sub 30A is in fluid communication with bore 21 of drill string 16 (FIG. 1). So that when drilling fluid DF flows through bore 21, drilling fluid DF is directed to bore 43A of circulation sub 30A via connection between drill string 16 and circulation sub 30A. After entering bore 43A, drilling fluid DF comes into contact with the receiving end 59A of the CAM cylinder 50A. The reduced cross-sectional area of opening 62A interferes with the flow of drilling fluid DF through CAM cylinder 50A; which generates a force $F_{DF}$ that is exerted onto the CAM cylinder 50A to urge the CAM cylinder 50A towards sleeve 46A. In the example shown, force $F_{DF}$ is substantially parallel with axis $A_X$; but examples exist where force $F_{DF}$ and axis $A_X$ are oblique. Referring back to FIG. 5A, the force $F_{DF}$ applied to CAM cylinder 50A creates a resulting force to urge the following pin 50A along the path of the groove pattern 72A. In an example, Force $F_{DF}$ is analogous to force F−.

Further in this example of operation, a force FBM is maintained against rearward end 70A that transfers to CAM cylinder 50A, and which has a component oriented opposite $F_{DF}$. In one embodiment force $F_{BM}$ is resilient and has a magnitude that varies in response to axial movement of the circulation sub sleeve 46A. Further optionally, force $F_{BM}$ is applied continuously during operation of the circulation sub 30A. In an example, force $F_{BM}$ has a magnitude sufficient to urge circulation sub sleeve 46A and CAM cylinder 50A in a direction opposite force $F_{DF}$ when force $F_{DF}$ is reduced or is removed; and where the movement of circulation sub sleeve 46A and CAM cylinder 50A results in moving following pin 58A in a direction of F+ (FIG. 5A) and along groove pattern 72A. One manner of reducing or removing force $F_{DF}$ includes adjusting or suspending a flow rate of drilling fluid DF contacting receiving end 59A. Force $F_{BM}$ is optionally exerted by a biasing means, and as illustrated in the example of FIGS. 7A, 7B, and 7C, biasing means are springs 78$_{1,2}$ on the rearward end 70A of circulation sub sleeve 46A. Referring back to FIG. 5A, in a non-limiting example of operation force $F_{DF}$ is applied to CAM cylinder 50A with a magnitude that exceeds force $F_{BM}$ by an amount sufficient to overcome any other forces impeding movement of CAM cylinder 50A and circulation sub sleeve 46A. Further in this example, this application of force $F_{DF}$ in turn moves following pin 58A along one of the following sequences: from oblique leg 74$A_1$ into vertical leg 76$A_1$, from vertical leg 76$A_2$ into vertical leg 76$A_3$ via oblique leg 74$A_3$, from vertical leg 76$A_4$ into vertical leg 76$A_5$ via oblique leg 74$A_5$, from vertical leg 76$A_6$ into vertical leg 76$A_7$ via oblique leg 74$A_7$, and from vertical leg 76$A_8$ into oblique leg 74$A_9$. Conversely, when force $F_{DF}$ is removed and force $F_{BM}$ remains with a magnitude sufficient to overcome any other forces impeding movement of CAM cylinder 50A and circulation sub sleeve 46A, application of force $F_{BM}$ causes movement of the following pin 58A along one of the following sequences: from vertical leg 76$A_1$ into vertical leg 76$A_2$ via oblique leg 74$A_2$, from vertical leg 76$A_3$ into vertical leg 76$A_4$ via oblique leg 74$A_4$, from vertical leg 76$A_5$ into vertical leg 76$A_6$ via oblique leg 74$A_6$, from vertical leg 76$A_7$ vertical leg 76$A_8$ via oblique leg 74$A_8$.

Referring to FIG. 7A, in the illustrated respective examples of the CAM cylinder 50A and circulation sub sleeve 46A and when viewed along axis $A_X$ on a side of CAM cylinder 50A opposite circulation sub sleeve 46A; the radial edge 56A is spaced angularly clockwise from the radial edge 66A. When the CAM cylinder 50A and circulation sub sleeve 46A are arranged as shown, and because the helical configurations of the sleeve end 54A and cylinder end 64A are complementary to one another; the section of the skirt 52A having the greater length $L_{52A(\ominus)}$ is azimuthally adjacent the section of the skirt 63A having the lesser length $L_{63A(\ominus)}$. In this configuration, the circulation sub sleeve 46A is maintained in a position with its ports 68$A_{1,2}$ spaced axially away from openings 48$A_{1,2}$ formed through circulation sub 30A; and for the purposes of discussion herein the circulation sub 30A is in a closed or unactivated configuration.

Further in this example of operation, the circulation sub 30A is reconfigured into a selective release or bypass/diverting configuration by successively cycling a flow of drilling fluid DF to the circulation sub 30A. As described above, the drilling fluid DF generates axial force $F_{DF}$ onto CAM cylinder 50A; by cycling the flow of drilling fluid DF, axial force $F_{DF}$ applied to CAM cylinder 50A is also cycled. Cycling force $F_{DF}$ in combination with the constantly applied force $F_{BM}$ indexes the following pin 58A along the groove pattern 72A as above described to rotate the CAM cylinder 50A. Continued cycling eventually rotates the CAM cylinder 50A to an azimuthal orientation represented in FIG. 7B; which as shown azimuthally aligns CAM cylinder 50A so that portions of skirts 52A, 63A in interfering contact with one another have respectively increased lengths $L_{52A(\ominus)}$, $L_{63A(\ominus)}$ over that of the unactuated or standby configuration of FIG. 7A. Increasing the lengths $L_{52A(\ominus)}$, $L_{63A(\ominus)}$ of skirts 52A, 63A that are in interfering contact urges circulation sub sleeve 46A axially away from groove pattern 72A. Similar to the example of FIG. 3B, shown in the configuration of the circulation sub 30A in FIG. 7B is that ports $\mathbf{68}A_{1,\ 2}$ are in partial registration with openings $\mathbf{48}A_{1,\ 2}$; and which illustrates an example of a selective release mode.

Shown in perspective view in FIG. 7C is an example of a bypass or diverting configuration of the circulation sub 30A, which is formed by additional cycling of drilling fluid DF and force $F_{DF}$ to further rotate CAM cylinder 50A with respect to circulation sub sleeve 46A. In the illustrated example of the bypass or diverting configuration, the radial edge 56A is spaced angularly counter-clockwise from radial edge 66A so that the portions of the ends 54A, 64A in interfering contact are along sections of the skirts 56A, 63A with substantially maximum lengths $L_{52A(\ominus)}$, $L_{63A(\ominus)}$. Contacting the respective ends 54A, 64A along these circumferential portions urges the circulation sub sleeve 46A axially farther away from the groove pattern 72A than in the selective release mode. Further illustrated in FIG. 7C is that a compression of the biasing means $\mathbf{78}A_{1,2}$ occurs which is also greater than in the selective release mode of FIG. 7B. In this example of operation, the openings $\mathbf{48}A_{1,2}$ substantially fully register with the ports $\mathbf{68}A_{1,2}$ and form passages $\mathbf{80}A_{1,2}$ that allow fluid communication between bore 43A and into the annulus 24 of wellbore 12. In this configuration illustrated in FIG. 7C, the substantially full registration of the openings $\mathbf{48}A_{1,2}$ and ports $\mathbf{68}A_{1,2}$ provides a substantially full bypass flow of the drilling fluid DF.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A drilling system for use to excavate in a wellbore comprising:

a drill string;

a drill bit on an end of the drill string; and a circulation sub coupled to the drill string and that comprises, a selectively rotatable cam cylinder having a receiving end in fluid communication with the drill string, sidewalls projecting axially from the receiving end having a varying axial length around a circumference of the cam cylinder, and a sleeve end at a terminal end of the sidewalls opposite from the receiving end, a sleeve having a cylinder end in contact with the sleeve end, and that is axially moveable in response to rotation of the cam cylinder, and an opening formed radially through a sidewall of the circulation sub that selectively registers with a port in a sidewall of the sleeve when the cam cylinder is in a designated azimuthal orientation to define a passage through which an inside the circulation sub is in communication with the wellbore.

2. The drilling system of claim 1, further comprising a groove pattern formed in a surface of the circulation sub and a following pin mounted to the cam cylinder inserted into the groove pattern, so the cam cylinder is rotated about an axis of the circulation sub in response to being axially urged.

3. The drilling system of claim 2, wherein the designated azimuthal orientation comprises a first designated azimuthal orientation, and wherein the groove pattern and following pin are strategically formed so that orienting the following pin into a second designated azimuthal orientation partially registers the opening and the port.

4. The drilling system of claim 2, wherein the designated azimuthal orientation comprises a first designated azimuthal orientation, and wherein the groove pattern and following pin are strategically formed so that orienting the following pin into a third designated azimuthal orientation positions the port away from the opening.

5. The drilling system of claim 1, wherein the varying axial length of the sidewalls of the cam cylinder define a helically shaped profile along the sleeve end.

6. The drilling system of claim 1, further comprising an orifice formed axially in the cam cylinder.

7. The drilling system of claim 6, wherein fluid flowing through the drill string is directed through the orifice, and which generates a force to urge the cam cylinder against the sleeve.

8. The drilling system of claim 1, wherein the cylinder end is profiled complementary to the sleeve end.

9. The drilling system of claim 8, wherein the swage point is disposed proximate a diameter transition in the wellbore.

10. The drilling system of claim 1, further comprising an urging means on an end of the sleeve opposite the cylinder end for urging the sleeve against the cam cylinder so that the cylinder end and sleeve end are in engaging contact while the cam cylinder is rotated.

11. The drilling system of claim 1, wherein a diameter of the drill string is reduced at a swage point between the circulation sub and the drill bit.

12. A drilling system for use to excavate in a wellbore comprising:

a drill string having an inner bore with a selective flow of fluid;

a drill bit on an end of the drill string;

a change in diameter of the drill string that defines a transition; and a circulation sub in the drill string comprising, a housing with a bore that is in fluid communication with the inner bore of the drill string, a cam cylinder selectively rotatable in the bore of the housing having a receiving end, a sleeve and spaced axially from the receiving end, sidewalls extending between the receiving end and sleeve end, the sidewalls having an axial length that varies about a circumference of the cam cylinder to define a profile along the sleeve end, a sleeve having a cylinder end in abutting contact with the sleeve end of the cam cylinder, the cylinder end having a profile complementary to the profile on the sleeve end, and a passage formed radially through the housing when the cam cylinder is in a designated azimuth.

13. The drilling system of claim 12, wherein the sleeve is selectively moved axially within the bore of the housing in response to rotation of the cam cylinder.

14. The drilling system of claim 13, wherein the profile on the sleeve end is helically shaped.

15. The drilling system of claim 13, wherein the cam cylinder and sleeve are in contact with one another along respective ends that are helically shaped.

16. A method of using a drilling system to excavate in a wellbore comprising:

contacting a drill bit with a subterranean formation;

rotating a drill string that is attached to the drill bit;

directing a flow of fluid through the drill string;

when a diameter of the wellbore reduces to define a transition that is uphole of the drill bit, optimizing an equivalent circulating density of fluid in an annulus between the drill string and walls of the wellbore by selectively diverting a portion of the flow of fluid into the wellbore uphole of the transition by indexing a cam cylinder integral with the drill string into an orientation that creates fluid communication between the fluid flowing through the drill string and the wellbore.

17. The method of claim 16, wherein the cam cylinder is part of a circulation sub that further comprises a sleeve disposed coaxial with the cam cylinder and having a port formed radially through a sidewall that registers with an opening in a side of the circulation sub to form a passage, wherein fluid communication between the fluid flowing through the drill string and the wellbore bore is through the passage.

18. The method of claim 17, wherein the cam cylinder and sleeve are each generally annular members having sidewalls that each having an axial length that varies azimuthally so that ends of each of the sidewalls follow a helically shaped path, and wherein the ends following the helically shaped path are in contact with one another so that the sleeve moves axially with rotation of the cam cylinder, and wherein an orifice is disposed in the cam cylinder through which the flow of fluid in the drill string is directed and exerts a force onto the cam cylinder that varies with a flowrate of the flow of fluid.

19. The method of claim 16, wherein selectively diverting a portion of the flow of fluid into the wellbore adjusts an equivalent circulating density of the fluid in the wellbore.

20. The method of claim 16, wherein the transition is proximate where an outer diameter of the drill string transitions to a different size.

* * * * *